US011799219B2

(12) United States Patent
Bramhe et al.

(10) Patent No.: US 11,799,219 B2
(45) Date of Patent: Oct. 24, 2023

(54) COMBINATION CIRCUIT BOARD RETENTION AND INTERCONNECT

(71) Applicant: Steering Solutions IP Holding Corporation, Saginaw, MI (US)

(72) Inventors: Mangesh Bramhe, Flint, MI (US); Eric D. Pattok, Frankenmuth, MI (US)

(73) Assignee: Steering Solutions IP Holding Corporation, Saginaw, MI (US)

( * ) Notice: Subject to any disclaimer, the term of this patent is extended or adjusted under 35 U.S.C. 154(b) by 257 days.

(21) Appl. No.: 17/198,864

(22) Filed: Mar. 11, 2021

(65) Prior Publication Data

US 2021/0288418 A1 Sep. 16, 2021

Related U.S. Application Data

(60) Provisional application No. 62/989,355, filed on Mar. 13, 2020.

(51) Int. Cl.
*H01R 12/70* (2011.01)

(52) U.S. Cl.
CPC ..... *H01R 12/7047* (2013.01); *H01R 2201/26* (2013.01)

(58) Field of Classification Search
CPC ..... H01R 12/7047; H01R 2201/26; H01R 12/73; H01R 12/714; H01R 12/62; H01R 31/06; H01R 12/52; H01R 13/02; H01R 35/02; H05K 1/14; H05K 1/145
See application file for complete search history.

(56) References Cited

U.S. PATENT DOCUMENTS 3,572,322 A * 3/1971 Wade ..... A61B 5/113 600/483
4,878,293 A * 11/1989 Kinser, Jr ..... H05K 1/028 29/850
6,024,702 A * 2/2000 Iversen ..... A61B 5/291 600/378
10,687,424 B2 * 6/2020 Benkley, III ..... H05K 1/111
(Continued)

FOREIGN PATENT DOCUMENTS

CN 1577993 A 2/2005
CN 1101573626 A 11/2009
(Continued)

OTHER PUBLICATIONS

English translation of Office Action regarding corresponding CN App. No. 2021102747601; dated May 10, 2023.

*Primary Examiner* — Peter G Leigh
*Assistant Examiner* — Nader J Alhawamdeh
(74) *Attorney, Agent, or Firm* — Dickinson Wright PLLC

(57) ABSTRACT

An interconnect assembly includes a main body being formed of flexible material and extending between a first end and a second end, the main body having a thickness defined by a top surface and a bottom surface. The interconnect assembly also includes a first connection port located proximate the first end. The interconnect assembly further includes a second connection port located proximate the second end. The interconnect assembly yet further includes a copper trace having a first contact and a second contact, the first contact disposed on the top surface and located adjacent to the first connection port, and the second contact located on the top surface and adjacent to the second connection port.

15 Claims, 7 Drawing Sheets

(56) References Cited

U.S. PATENT DOCUMENTS

| | | | | |
|---|---|---|---|---|
| 11,109,478 | B2 * | 8/2021 | Klenk | B62D 5/0406 |
| 2002/0092675 | A1 | 7/2002 | Kusaka | |
| 2006/0189179 | A1 * | 8/2006 | Dittmann | H01R 12/52 439/74 |
| 2006/0264096 | A1 * | 11/2006 | Johnson | H01R 12/7005 439/566 |
| 2013/0122199 | A1 * | 5/2013 | Huda | B05B 16/00 427/256 |
| 2018/0213646 | A1 * | 7/2018 | Benkley, III | H05K 1/183 |
| 2019/0150269 | A1 * | 5/2019 | Klenk | H02K 11/30 310/68 R |
| 2019/0263337 | A1 * | 8/2019 | Utsunomiya | H01R 35/025 |
| 2021/0288418 | A1 * | 9/2021 | Bramhe | H01R 12/73 |

FOREIGN PATENT DOCUMENTS

| | | | | |
|---|---|---|---|---|
| CN | 102017313 | A | 4/2011 | |
| CN | 201903812 | U | 7/2011 | |
| CN | 108701732 | A | 10/2018 | |
| WO | WO-2018088235 | A1 * | 5/2018 | G06K 9/00006 |

* cited by examiner

COMBINATION CIRCUIT BOARD RETENTION AND INTERCONNECT

CROSS-REFERENCE TO RELATED APPLICATION

This application claims the benefit of priority to U.S. Provisional Patent Application Ser. No. 62/989,355, filed Mar. 13, 2020, the disclosure of which is incorporated by reference herein in its entirety.

BACKGROUND

The present disclosure relates to a combination circuit board and, more particularly, to a combination circuit board including a retention and interconnection system.

Vehicles have mechanical and electrical components that are the subject of many different types of stresses, such as rough driving surfaces, internal vibrations, and exposure to a broad range of environments. Modern vehicle architecture requires certain components, particularly electrical components, to include multi-piece construction. When a component includes multi-piece construction, interconnection between the pieces can be expensive and subject to the stresses noted above. One such electrical component that requires a multi-piece construction is a combination circuit board located in a column motor power pack that is utilized in power steering systems and, more particularly, electronic power steering systems. Combination circuit boards are generally interconnected via interconnects that are multi-piece plastic injected sub-assemblies. Once constructed, utilizing interconnects is typically a time-consuming process requiring soldering between respective electrical components.

Accordingly, it would be beneficial to develop interconnects utilized for multi-piece electrical components that are cost effective, durable, and easy to incorporate into an electrical component once constructed.

SUMMARY OF THE DISCLOSURE

This section provides a general summary of the disclosure and is not to be interpreted as a complete and comprehensive listing of all of the objects, aspects, features and advantages associated with the present disclosure.

According to one aspect of the disclosure, an interconnect assembly includes a main body being formed of flexible material and extending between a first end and a second end, the main body having a thickness defined by a top surface and a bottom surface. The interconnect assembly also includes a first connection port located proximate the first end. The interconnect assembly further includes a second connection port located proximate the second end. The interconnect assembly yet further includes a copper trace having a first contact and a second contact, the first contact disposed on the top surface and located adjacent to the first connection port, and the second contact located on the top surface and adjacent to the second connection port.

According to another aspect of the disclosure, a combination circuit board assembly includes a first circuit board. The combination circuit board assembly also includes a second circuit board electrically connected to the first circuit board with an interconnect assembly. The interconnect assembly includes a main body being formed of flexible material and extending between a first end and a second end. The interconnect assembly also includes a plurality of copper traces disposed on the main body.

These and other advantages and features will become more apparent from the following description taken in conjunction with the drawings.

BRIEF DESCRIPTION OF THE DRAWINGS

The subject matter that is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

The description herein is directed to various embodiments of the disclosure. Although one or more of these embodiments may be illustrated and/or discussed in greater detail, relative to other embodiments, the disclosure should not be interpreted, or otherwise used, as limiting the scope of the disclosure. In addition, one skilled in the art will understand that the following description has broad application, and the discussion of any embodiment is meant only to be exemplary of that embodiment, and not intended to intimate that the scope of the disclosure, including the claims, is limited to that embodiment.

As described, a vehicle, such as a car, truck, sport utility vehicle, crossover, mini-van, marine craft, aircraft, all-terrain vehicle, recreational vehicle, or other suitable vehicles, includes one or more steering system schemes, such as steer-by-wire and driver interface steering, for example. These steering system schemes typically include a steering column for translating steering input to an output that interacts with a steering linkage to cause the vehicle wheels (or other elements) to turn the vehicle. Some steering columns are axially adjustable between positions to provide flexibility in the location of the hand wheel and facilitate more comfortable driving positions for various drivers or autonomous driving capability.

Referring now to the Figures, where the invention will be described with reference to specific embodiments, without limiting same, an interconnect assembly 10 is shown. The interconnect assembly 10 is intended for providing an enhanced system for connecting at least two electrical components, such as two or more circuit boards in a combination circuit board, as can be appreciated from the disclosure herein.

Figure 1:
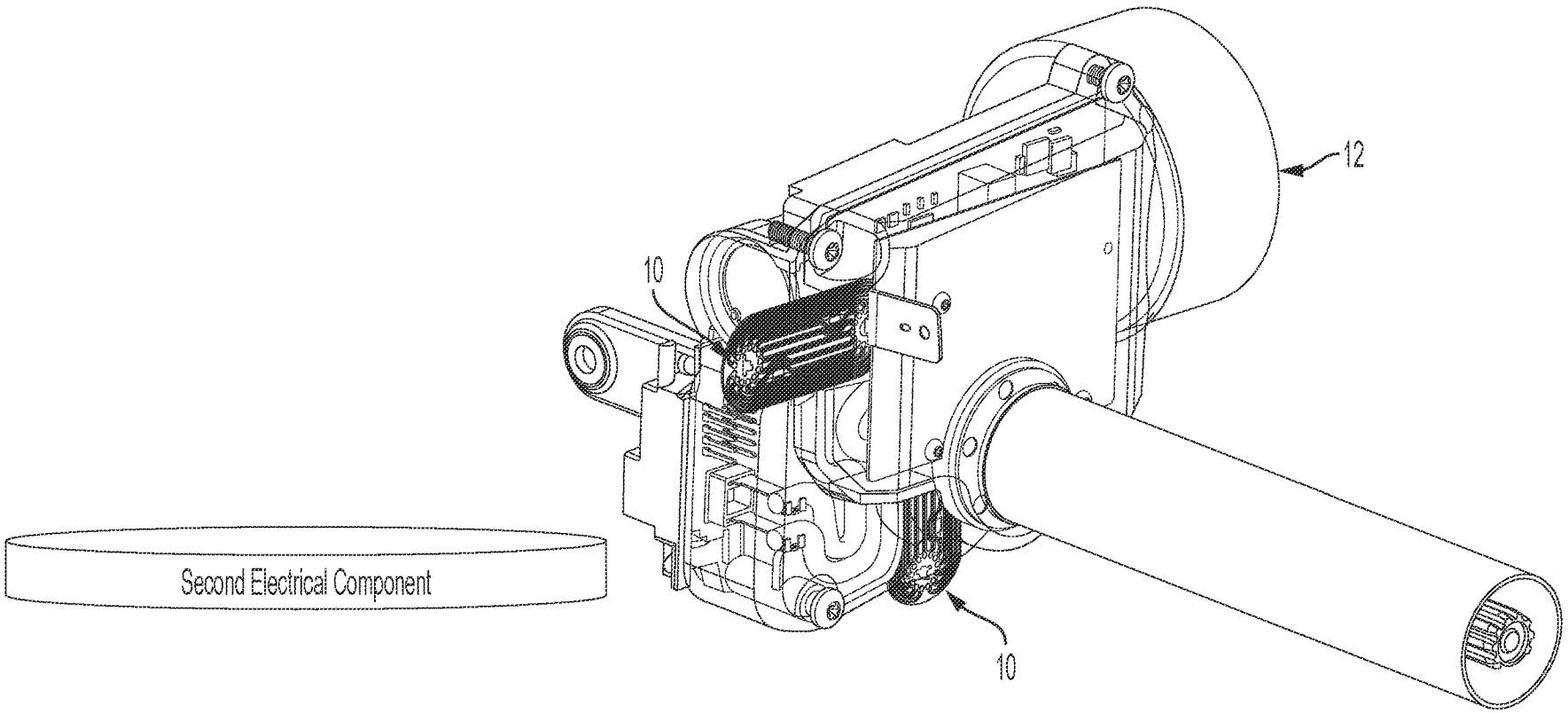
FIG. 1 is a perspective view of an interconnect assembly connected with a motor power pack for an electric power steering system.

With initial reference to FIG. 1, a pair of interconnect assemblies 10 are shown connected with a motor power pack 12 for an electric power steering system in accordance with one example application of the subject invention.

Figure 2:
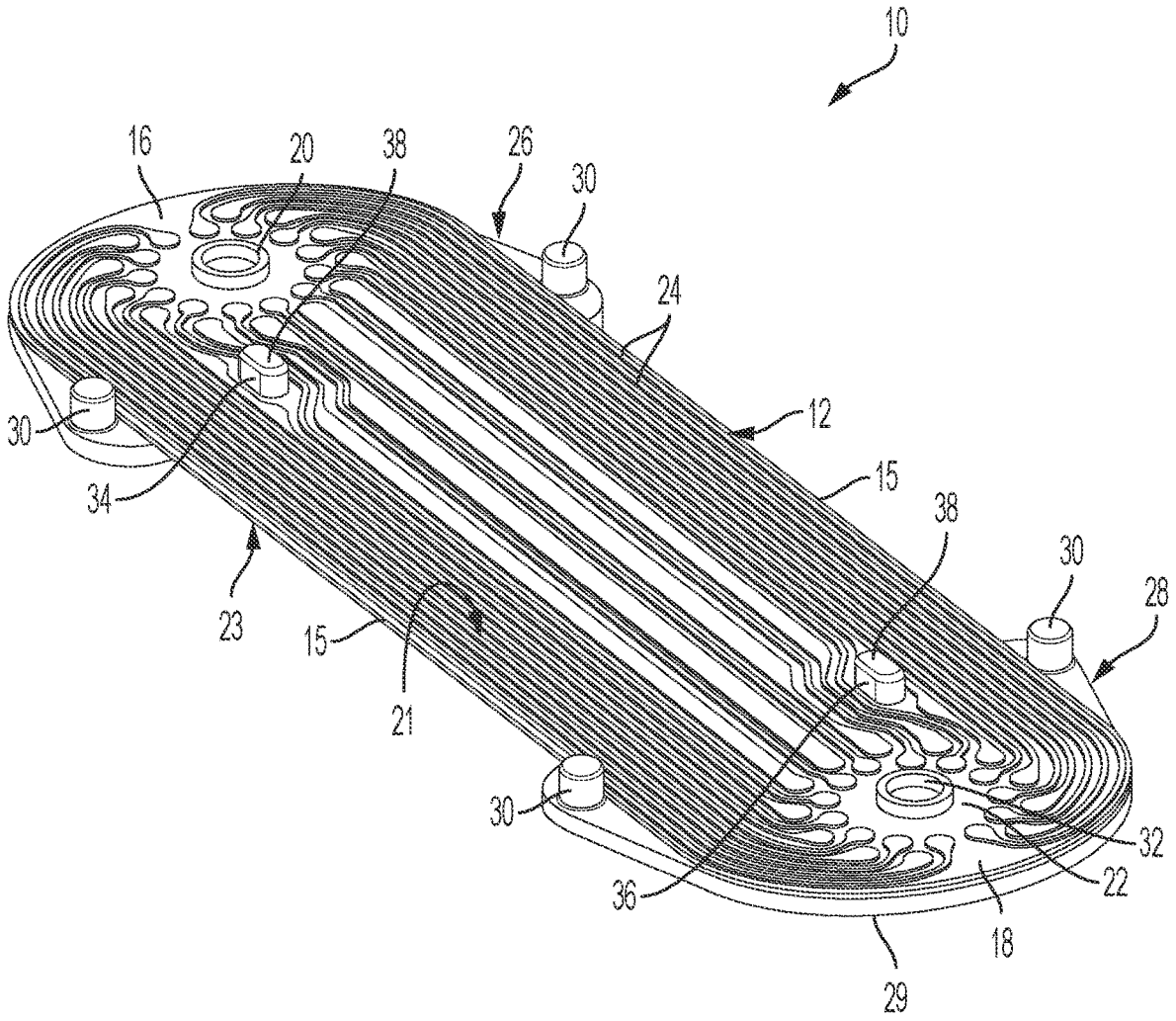
FIG. 2 is a perspective view of the interconnect assembly that includes a main body of flexible material and a pair of covers.

As shown in FIG. 2, the interconnect assembly 10 includes a main body 12 extending between a pair of longitudinal edges 15 from a first end 16 to a second end 18. The main body 12 is formed of flexible material and has a thickness defined by a top surface 21 and a bottom surface 23. A first connection port 20 extends through the thickness of the main body 12 proximate the first end 16 of the main body 12. A second connection port 22 extends through the thickness of the main body 12 proximate the second end 18 of the main body 12. Reference to the ports being located "proximate" a respective end of the main body 12 is defined as the port being located closer to the referenced end, relative to its distance from the other end. In some embodiments, the port is located closer to the referenced end, relative to its distance from the longitudinal mid-point of the main body 12.

At least one copper trace 24 extends from a location proximate the first connection port 20 to a location proximate the second connection port 22 along the top surface 21. In some arrangements, the at least one copper trace 24 is defined by a plurality of copper traces 24. Each copper trace 24 may sit flush with the top surface 21. In use, the first connection port 20 is connected to a first electronic component (e.g., a first circuit board) and the second connection port 22 is connected to a second electronic component (e.g., a second circuit board). During connection to the respective ports 20, 22, the electronic components are disposed in contact with the copper traces 24.

To support the connection between the ports 20, 22 and electronic components, the interconnect assembly 10 further includes a first cover 26 for connection to the first end 16 and a second cover 28 for connection to the second end 18. Each cover 26, 28 includes a base 29 for covering the bottom surface 23 of one of the ends 16, 18 of the main body 12. Depending on the application, the base 29 can shield portions of the main body 12 from additional automotive components or environmental conditions. Each cover 26, 28 further includes a pair of posts 30 for positioning on longitudinal edges 15 of the main body 12. Each cover 26, 28 also includes a sleeve portion 32 that extends from the base 29 and is sized to extend through one of the connection ports 20 or 22. The main body 12 and each cover 26, 28 further include poka-yoke features to ensure that the main body 12 is oriented correctly during installation.

As used herein, a poka-yoke connection means an error proof connection. That is, a connection cannot reasonably be made between the respective connection ports 20, 22, and mating components of the electrical components, without causing damage to one of the connection ports or mating components. The poka-yoke connection is advantageous because it prevents an improper connection from being made during assembly. More specifically, the main body 12 includes a first aperture 34 located proximate the first end 16 and one of the longitudinal edges 15 and a second aperture 36 located proximate the second end 18 and the other of the longitudinal edges 15. Each cover 26, 28 includes a tab 38 that is located on the base 29 for extending through one of the apertures 34, 36. The apertures 34, 36 and tabs 38 may be non-circular shaped to prevent rotation of the tab 38 relative to the aperture 34, 36.

Figure 3:
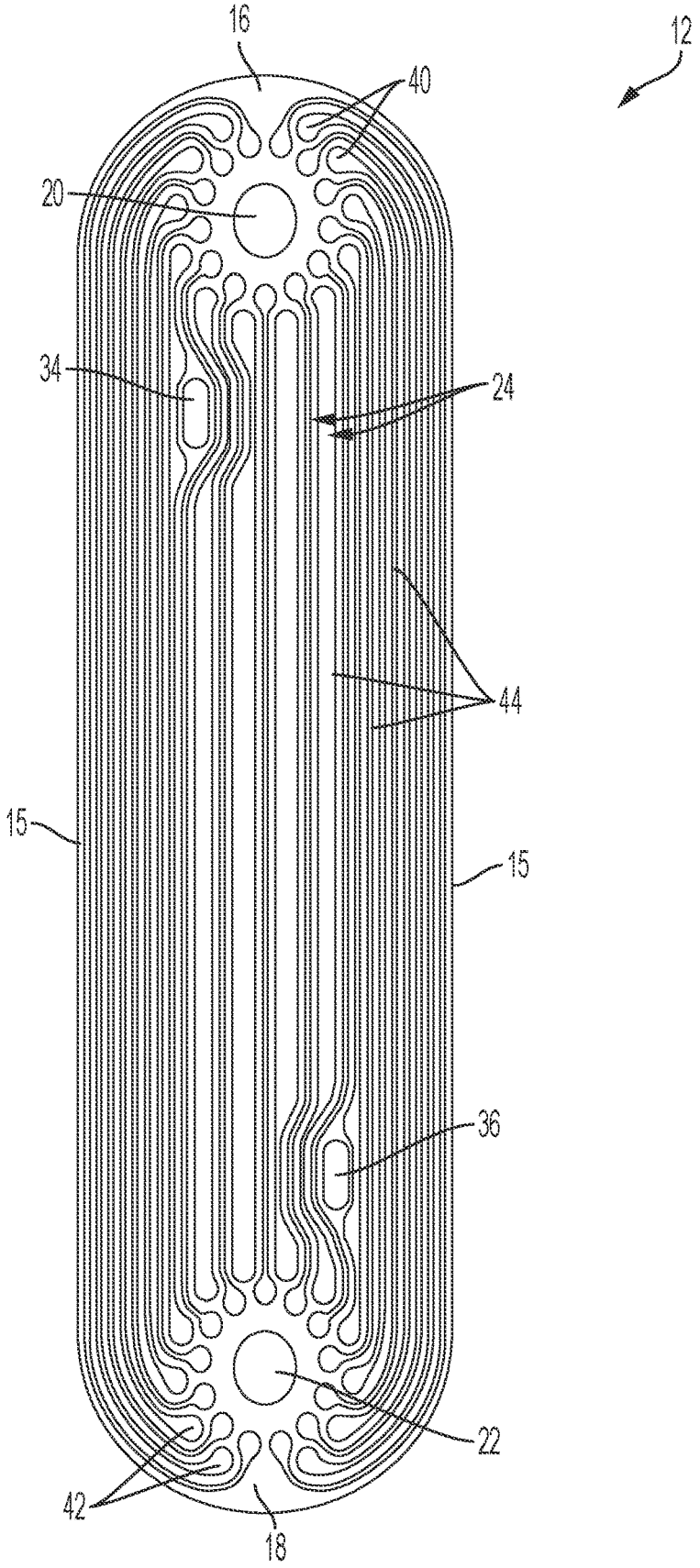
FIG. 3 is a plan view of the main body.

FIG. 3 is a top view of the main body 12 illustrating one example arrangement of copper traces 24. Each copper trace 24 includes a first contact 40 that is located near the first connection port 20 for establishing electrical communication with the first electronic component and a second contact 42 that is located near the second connection port 22 for establishing electrical communication with the second electrical component. Each copper trace 24 further includes an elongated body 44 extending between the first and second contact 40, 42 for facilitating communication between the electrical components. Each of the contacts 40, 42 may be arranged in in at least one array around the respective connection ports 20, 22. As illustrated in the example arrangement, the contacts 40, 42 are each arranged in a first array and a second array that is radially outwardly located about the first array. The first end 16 and second end 18 may each have a rounded profile such that the main body 12 has a general shape of a rectangle with a semi-circle or semi-ellipse on either end 16, 18. The copper traces 24 may cover a majority of the top surface 21. The various copper traces 24 may have different thicknesses or gauges on the same main body 12.

Figure 4:
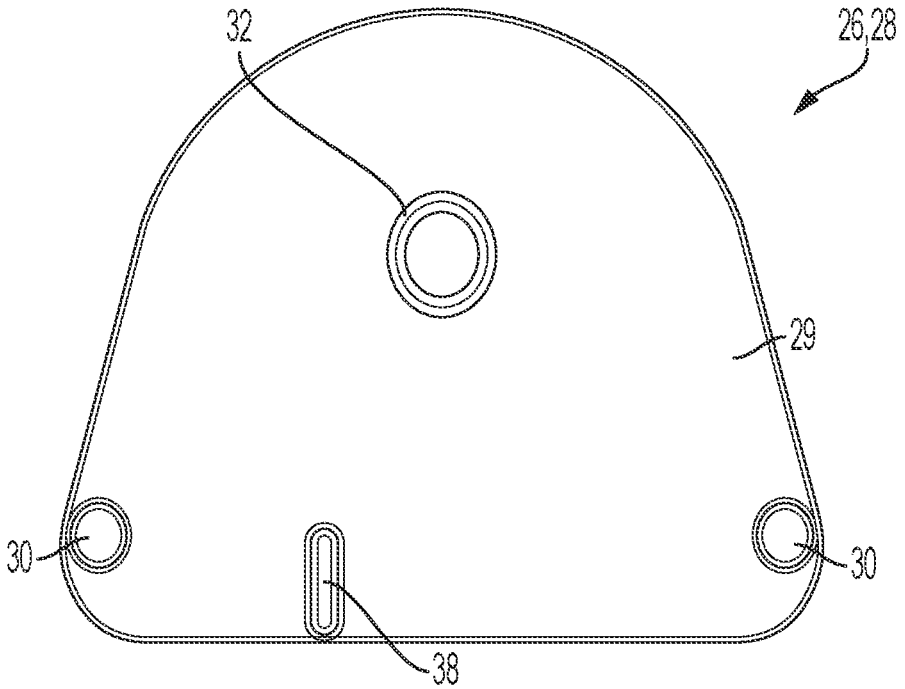
FIG. 4 is a plan view of one of the pair of covers.

FIG. 4 is a top view of one of the covers 26, 28. Each cover 26, 28 may be formed of insulating material, such as plastic, for example. The base 29 may have a rounded shape to underlie the ends 16, 18 of the main body 12. The covers 26, 28 may be rigid in some embodiments. In other embodiments, the covers 26, 28 are flexible like the main body 12. When connected to the main body 12, the sleeve portion 32 is located close to one of the ends 16, 18, at least a portion of the posts 30 are located further from the end 16, 18, and at least a portion of the tab 38 is located further yet from the end 16, 18.

Figure 5:
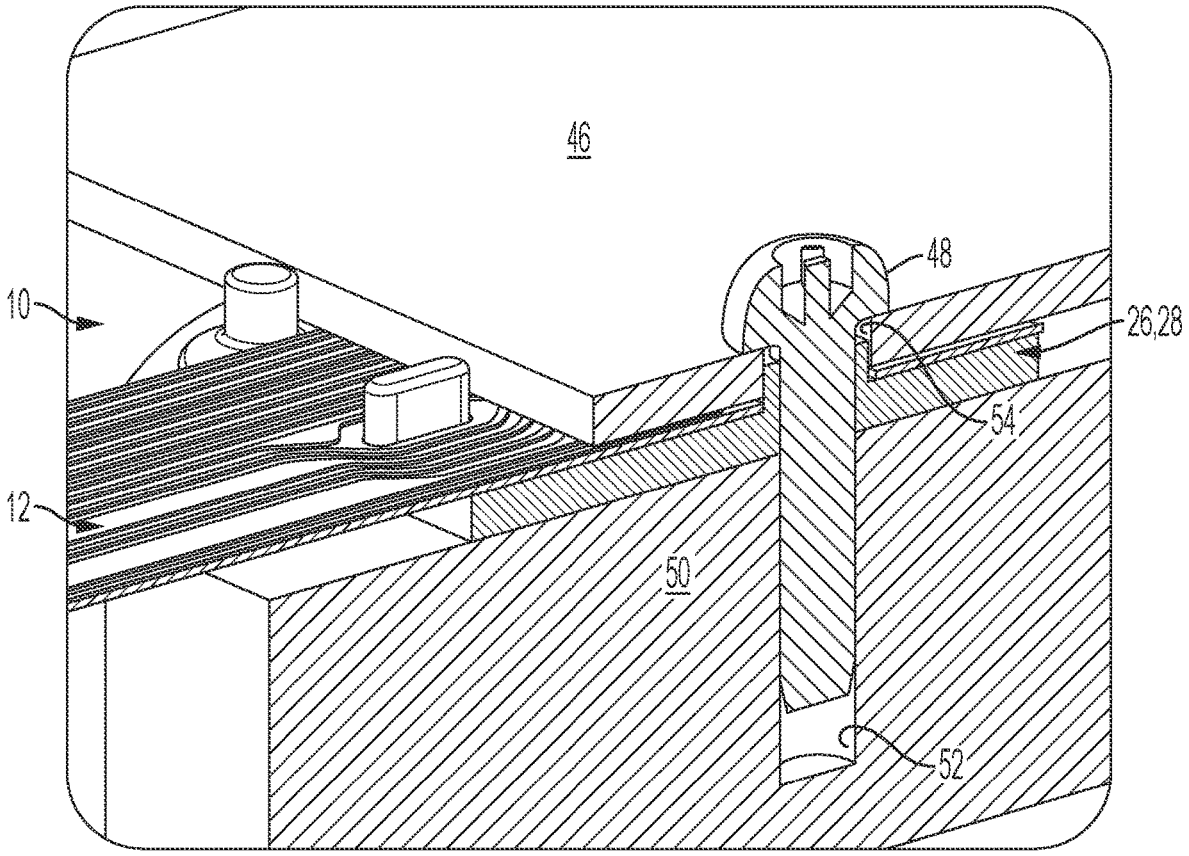
FIG. 5 is an enlarged, perspective view of the interconnect assembly connected to the motor power pack.

FIG. 5 is a close-up perspective view of the interconnect assembly 10 connected to the motor power pack 12 with a pair of circuit boards. In one arrangement, one of the circuit boards includes a controller 46. A fastener 48 extends through the controller 46, one of the connection ports, the sleeve portion 32 of the cover 26, 28, and into a housing 50 and more particularly, into a threaded hole 52 in the housing 50. The compression from tightening the fastener 48 results in the various contacts 40, 42 establishing and retaining electric communication with the controller 46 (or contacts of other electrical components). In the illustrated arrangement, the controller 46 includes an aperture 54 that is large enough to accommodate part of the sleeve portion 32 (see FIGS. 2 and 4).

Figure 6:
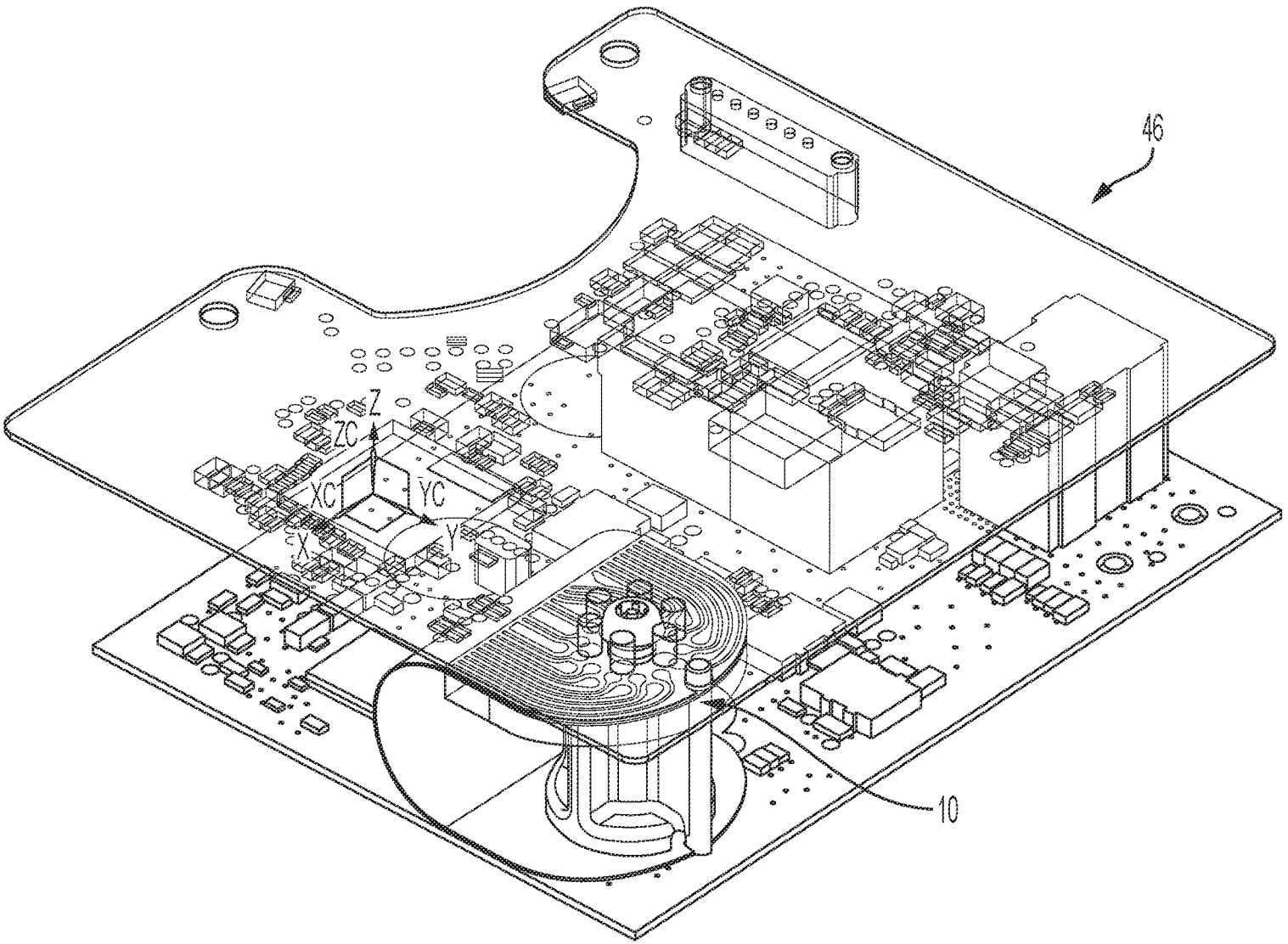
FIG. 6 is a perspective view of the interconnect assembly connected to two controller boards according to an aspect of the disclosure.
Figure 7:
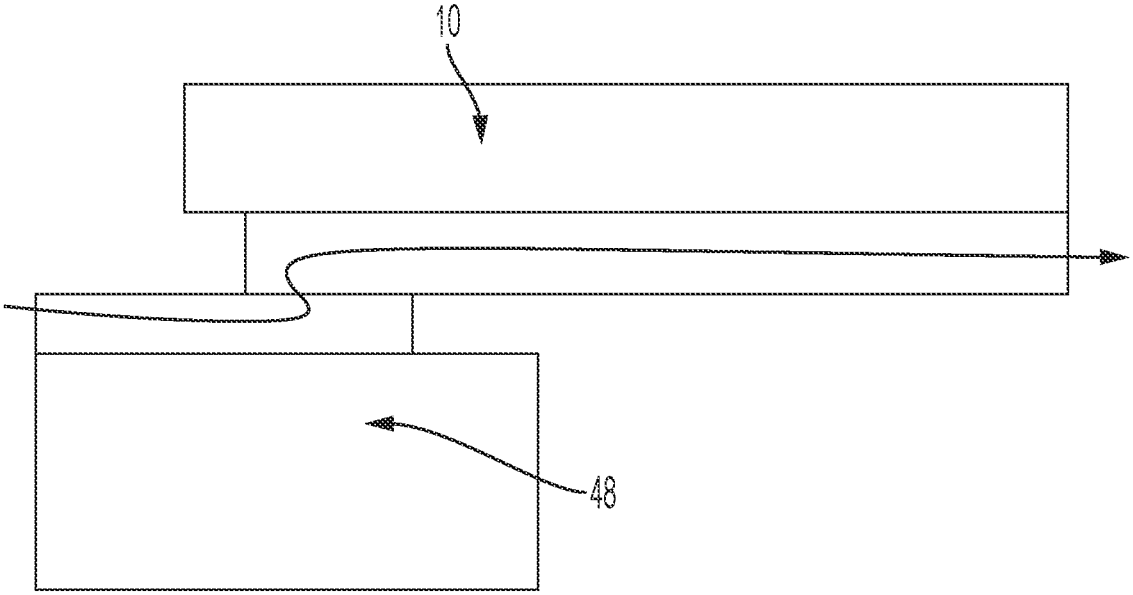
FIG. 7 is a schematic illustrating a trace-to-trace connection provided by the interconnect assembly.

FIGS. 6 and 7 illustrate the interconnect assembly 10 in additional detail. The interconnection assembly 10 is shown disposed between two controller boards (FIG. 6). FIG. 7 illustrates a trace-to-trace connection provided by the embodiments of the interconnect assembly 10 disclosed herein. Advantageously, the disclosed embodiments do not require any additional conductors in the path between the flexible interconnect assembly board 10 and the rigid controller board 46. Examples of components that may be required in other designs are rod type pins, c-shaped pins, pins and sockets. Systems that do not have extra pin type pieces require soldering to keep a good connection. The embodiments disclosed herein utilize high pressure from the mechanical fastener 48 in conjunction with the compliance of the plastic bodies (also referred to as covers) to ensure all circuits have—and maintain—good electrical connections.

In operation, the interconnect assembly 10 provides a flexible design for adapting to various layouts of first and second electrical components and that is easy to install. The compression that results from tightening the fastener 48 reduces the previous risks of short-circuiting. In addition, the interconnect 10 can be assembled without expensive tooling. This arrangement also facilitates disassembly without destroying components, allowing for factory re-work and servicing in the field. The copper traces 24 can be arranged differently for different applications with less expense when compared to typical other connections because these boards only need changes to the printed artwork versus hard tooling changes. The "trace-to-trace" connections described herein avoid the need for the use of electrical connections that rely on pins or other protruding structures, particularly in the embodiments of flush contacts described herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. An interconnect assembly comprising:

a main body being formed of flexible material and extending between a first end and a second end, the main body having a thickness defined by a top surface and a bottom surface;

a first connection port located proximate the first end;

a second connection port located proximate the second end; and a copper trace having a first contact and a second contact, the first contact disposed on the top surface and located adjacent to the first connection port, and the second contact located on the top surface and adjacent to the second connection port wherein the interconnect assembly includes a first cover underlying the first end and a second cover underlying the second end, wherein the main body, the first cover and the second cover each include a poka-yoke feature to facilitate connection to electrical components, wherein the poka-yoke feature comprises an aperture defined in the main body and a non-circular tab extending from the first cover or the second cover and through the aperture.

2. The interconnect assembly of claim 1, wherein the copper trace is disposed flush with the top surface of the main body.

3. The interconnect assembly of claim 1, wherein the copper trace protrudes from the top surface of the main body.

4. The interconnect assembly of claim 1, wherein the copper trace is recessed from the top surface of the main body.

5. The interconnect assembly of claim 1, wherein the copper trace is one of a plurality of copper traces, each of the plurality of copper traces having a first contact and a second contact.

6. The interconnect assembly of claim 1, wherein the main body comprises a rectangular section, the first end and the second end, wherein the first end and the second end have a curved geometry.

7. The interconnect assembly of claim 6, wherein the first end and the second end are each one of a semi-circle or a semi-ellipse.

8. The interconnect assembly of claim 1, wherein the first cover and the second cover are flexible.

9. The interconnect assembly of claim 1, wherein the first cover and the second cover are rigid.

10. A combination circuit board assembly comprising:

a first circuit board; and a second circuit board electrically connected to the first circuit board with an interconnect assembly, wherein the interconnect assembly comprises:

a main body being formed of flexible material and extending between a first end and a second end; and a plurality of copper traces disposed on the main body, wherein the interconnect assembly includes a first cover underlying the first end and a second cover underlying the second end, wherein the main body, the first cover and the second cover each include a poka-yoke feature to facilitate connection to electrical components, wherein the poka-yoke feature comprises an aperture defined in the main body and a non-circular tab extending from the first cover or the second cover and through the aperture.

11. The combination circuit board assembly of claim 10, wherein the interconnect assembly further comprises a first connection port and a second connection port, the first connection port located proximate the first end, the second connection port located proximate the second end, wherein each of the copper traces includes a first contact and a second contact, the first contact located adjacent to the first connection port, and the second contact located adjacent to the second connection port.

12. The combination circuit board assembly of claim 11, wherein the main body comprises a rectangular section, the first end and the second end, wherein the first end and the second end have a curved geometry.

13. The combination circuit board assembly of claim 12, wherein the first end and the second end are each one of a semi-circle or a semi-ellipse.

14. The combination circuit board assembly of claim 10, wherein the first cover and the second cover are flexible.

15. The combination circuit board assembly of claim 10, wherein the plurality of copper traces form a trace-to-trace connection between the interconnect assembly and one of the first circuit board and the second circuit board.

* * * * *